US010643528B2

(12) United States Patent
Selan

(10) Patent No.: US 10,643,528 B2
(45) Date of Patent: May 5, 2020

(54) ROLLING BURST ILLUMINATION FOR A DISPLAY

(71) Applicant: Valve Corporation, Bellevue, WA (US)

(72) Inventor: Jeremy Adam Selan, Kirkland, WA (US)

(73) Assignee: Valve Corporation, Bellevue, WA (US)

( * ) Notice: Subject to any disclaimer, the term of this patent is extended or adjusted under 35 U.S.C. 154(b) by 0 days.

(21) Appl. No.: 15/878,163

(22) Filed: Jan. 23, 2018

(65) Prior Publication Data

US 2019/0228700 A1 Jul. 25, 2019

(51) Int. Cl.

| | |
|---|---|
| ***G09G 3/32*** | (2016.01) |
| ***G09G 3/3208*** | (2016.01) |
| ***G09G 3/36*** | (2006.01) |

(52) U.S. Cl.

CPC ..... *G09G 3/3208* (2013.01); *G09G 3/3611* (2013.01); *G09G 2310/0237* (2013.01); *G09G 2310/08* (2013.01); *G09G 2320/0261* (2013.01); *G09G 2320/064* (2013.01); *G09G 2320/0653* (2013.01)

(58) Field of Classification Search

CPC ..... G09G 3/3208; G09G 3/3611; G09G 2310/08; G09G 2310/0237; G09G 2320/064–0653; G09G 2320/0261

See application file for complete search history.

(56) References Cited

U.S. PATENT DOCUMENTS

| | | | | |
|---|---|---|---|---|
| 7,088,051 | B1 * | 8/2006 | Cok | G09G 3/3233 315/169.1 |
| 2003/0067424 | A1 * | 4/2003 | Akimoto | G09G 3/3233 345/55 |
| 2006/0221015 | A1 * | 10/2006 | Shirasaki | G09G 3/325 345/77 |
| 2007/0008250 | A1 * | 1/2007 | Hoppenbrouwers | G09G 3/3225 345/76 |
| 2009/0219238 | A1 | 9/2009 | Furuya et al. | |
| 2011/0032342 | A1 * | 2/2011 | Kato | G09G 3/001 348/51 |

(Continued)

OTHER PUBLICATIONS

PCT Search Report and Writen Opinion dated Apr. 15, 2019 for PCT Application PCT/US19/14795, 10 pages.

*Primary Examiner* — Liliana Cerullo

(74) *Attorney, Agent, or Firm* — Lee & Hayes, P.C.

(57) ABSTRACT

A display has an array of light emitting elements. For a given frame of a series of frames that present images on the display at a refresh rate of the display, the light emitting elements may be driven by loading individual subsets of the light emitting elements in sequence with light output data, and by illuminating the individual subsets of the light emitting elements in the sequence and in accordance with the light output data, wherein an illumination time period is within a range of about 2% to 80% of a frame time of the frame, the frame time derivable from the refresh rate. This "rolling burst illumination" technique is characterized by the relatively short illumination time period (e.g., as compared to the frame time), and it can stabilize a scene (or mitigate unwanted visual artifacts) for a viewing user during head motion, as well as optimize display bandwidth utilization.

19 Claims, 7 Drawing Sheets

(56) References Cited

U.S. PATENT DOCUMENTS

| | | | | |
|---|---|---|---|---|
| 2013/0063469 | A1 | 3/2013 | Ruckmongathan | |
| 2014/0198114 | A1 | 7/2014 | Nambi et al. | |
| 2015/0042549 | A1 | 2/2015 | Hu | |
| 2015/0346495 | A1 | 12/2015 | Welch et al. | |
| 2016/0180767 | A1 | 6/2016 | Sakariya et al. | |
| 2017/0301313 | A1* | 10/2017 | Perreault | G02B 3/14 |
| 2018/0293942 | A1* | 10/2018 | Gu | G09G 3/3233 |

* cited by examiner

ROLLING BURST ILLUMINATION FOR A DISPLAY

BACKGROUND

Displays are used in a variety of electronic devices to present information to users. Emissive displays include light emitting elements that emit light when images are presented on the display. In today's displays, such light emitting elements are often in the form of light-emitting diodes (LEDs), such as those used in a backlight of a liquid crystal display (LCD), or those used in organic LED (OLED) displays.

In traditional LCD displays, the backlight is typically driven at a duty cycle of 100%, which means that the LEDs of the LCD backlight are always on during image presentation on the display. Images change, frame-by-frame, on the LCD by supplying electric current to a layer of liquid crystals that respond (e.g., twist or untwist) in accordance with the supplied electric current. 100% duty cycle LCDs are suitable for some display applications, but not for ones where fine motion rendition is desired, such as virtual reality (VR) display applications. This is because when a 100% duty cycle LCD is embedded in a VR headset, the large field of view (FOV) causes a scene to appear blurry (e.g., streaky or smeary) to the user of the VR headset whenever the user moves his/her head back and forth to look around the VR scene.

In traditional OLED displays, light is not emitted from all of the pixels (i.e., all of the OLEDs) at the same time. Rather, a typical driving scheme used in traditional OLED displays is to sequentially illuminate each row of pixels from the top row to the bottom row during a given frame. If this process could be shown to a user in slow motion, the viewing user would see a horizontal band of light traversing the display from top-to-bottom. In this "rolling band" technique, the rows of pixels (i.e., OLEDs) are sequentially loaded with light output data, followed by an immediate, sequential illumination of the rows of pixels. At each row, as soon as the loading process completes, the illumination process is started, which means that the OLEDs are sequentially illuminated at the same rate that the OLEDs are sequentially loaded with light output data. This type of driving scheme also has drawbacks in fine-motion-rendition applications, such as VR. This is because when traditional OLED displays are embedded in a VR headset, the large FOV causes a scene to appear distorted to the user of the VR headset during head motion (e.g., the VR scene may appear to move as if it were made of Jello, where the scene is squished and/or twisted as the user's head moves back and forth). Because these unwanted visual artifacts also present themselves during head motion, traditional OLED displays, like 100% duty cycle LCDs, are undesirable for use in VR applications.

Yet another known driving scheme for displays with individually-addressable LEDs is a "global flashing" scheme where, for a given frame, all of the LEDs of the display are simultaneously illuminated in synchronization following a "rolling band" type of loading process where each row of LEDs is loaded with light output data in sequence. While this "global flashing" technique mitigates much of the above-mentioned visual artifacts in VR applications, it is cost prohibitive to implement a global flashing scheme to drive the display. This is because a high number of costly hardware components are required to simultaneously illuminate all of the LEDs for each frame. Global flashing can also shorten the lifespan of the display hardware (e.g., the LEDs and the componentry utilized to supply power and electric current thereto) due to the high frequency power toggling used in this driving scheme.

Provided herein are technical solutions to improve and enhance these and other systems.

BRIEF DESCRIPTION OF THE DRAWINGS

The detailed description is described with reference to the accompanying drawings. In the figures, the left-most digit(s) of a reference number identifies the figure in which the reference number first appears. The use of the same reference numbers in different figures indicates similar or identical components or features.

DETAILED DESCRIPTION

Figure 1:
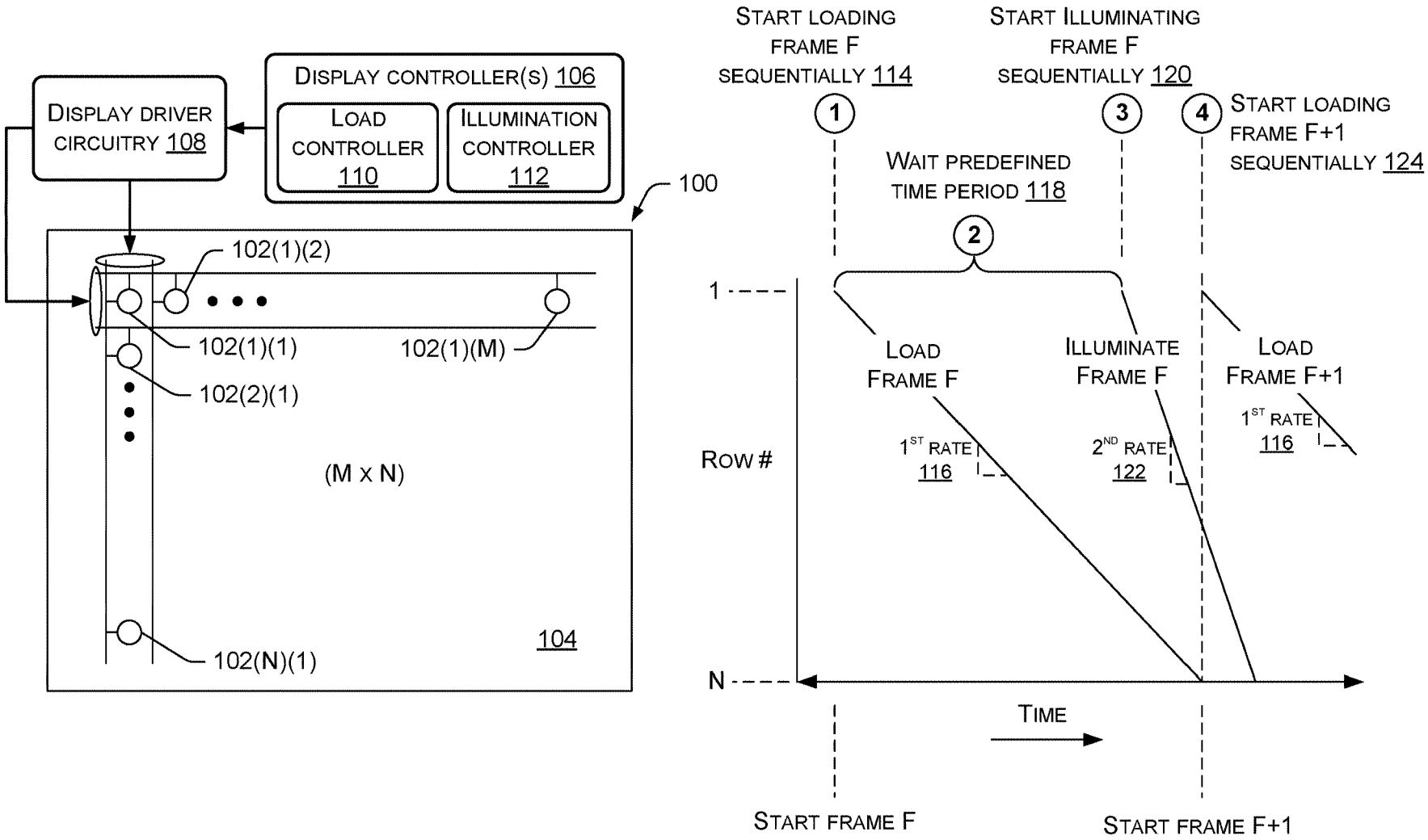
FIG. 1 is a diagram illustrating an example display, or a portion thereof, having an array of light emitting elements next to a graphical diagram to show a rolling burst illumination driving technique, in accordance with embodiments disclosed herein.

Described herein are, among other things, techniques for driving a display using a rolling burst illumination approach, as well as devices and systems (e.g., displays) for implementing the rolling burst illumination techniques. A display, according to the embodiments disclosed herein, can include an array of light emitting elements (or light sources). By way of example, and not limitation, such an array of light emitting elements may comprise light emitting diodes (LEDs) of a backlight of a LCD that emits light behind a display panel having pixels comprised of liquid crystals that twist or untwist in order to present a desired image on the LCD. By way of another example, and not limitation, such an array of light emitting elements may represent an array of organic LEDs (OLEDs) of an OLED display, where the OLEDs are disposed at the pixel-level and are configured to emit light during presentation of a desired image on the OLED display. As yet another example, and not limitation, such an array of light emitting elements may represent an array of inorganic LEDs (ILEDs) of an ILED display.

In order to drive the light emitting elements of the display, the display may include display driver circuitry coupled to the array of light emitting elements via conductive paths. The display driver circuitry may receive control signals and light output data from one or more controllers in order to control the display driver circuitry for illuminating the light emitting elements at particular times and at particular levels of light output.

This disclosure pertains to a display driving technique where the illumination time period over which the light emitting elements of the display are illuminated once during a given frame (or screen refresh) is relatively short, as compared to either or both of the loading time period or the frame time. In other words, the time period in which the light emitting elements are sequentially loaded with light output data (referred to herein as the "loading time period") and the time period for processing and displaying the frame (referred to herein as the "frame time"; the frame time derivable from the refresh rate) are both relatively long time periods as compared to a time period in which the light emitting elements are sequentially illuminated (referred to herein as the "illumination time period") during the processing of a given frame. Hence, the terminology "rolling burst illumination" is to connote a "burst" of illumination that propagates (or "rolls") across the display during the processing of each frame. In this manner, the speed at which an image is updated on the display (e.g., the refresh rate) is decoupled from the speed at which the light emitting elements are sequentially illuminated, allowing for the aforementioned "burst" of illumination.

An example display, according to the embodiments described herein, may operate as follows. For a given frame of a series of frames that present images on the display at a refresh rate of the display, one or more controllers of the display may cause the display driver circuitry to load individual subsets of the light emitting elements of the display in sequence (or sequentially) with light output data. After starting the loading processes, the controller(s) may cause the display driver circuitry to illuminate the individual subsets of the light emitting elements in the sequence (or sequentially) and in accordance with the light output data, where the sequential illumination of the light emitting elements transpires (from start to finish) over a relatively short period of time (e.g., as compared to the frame time and the loading time period). That is, for a given frame, an illumination time period—measured from a time of starting to illuminate a first subset of the light emitting elements to a time of starting to illuminate a last subset of the light emitting elements—may be within a range of about 2% to 80% of the frame time of the frame, the frame time derivable from the refresh rate. Furthermore, because the loading time period—measured from a time of starting to load the first subset of the light emitting elements with the light output data to a time of starting to load the last subset of the light emitting elements with the light output data—is a substantial portion of the frame time, the illumination time period is less than the loading time period. Moreover, each individual subset of light emitting elements is illuminated once, not multiple times, per frame.

A display that implements the "rolling burst illumination" techniques for driving its light emitting elements, as described herein, can mitigate unwanted visual artifacts in any display application where fine motion rendition is desired, and/or where a FOV of the user is relatively large, and/or where head motion is prevalent. Accordingly, the techniques and systems described herein can be utilized in VR applications and/or augmented reality (AR) applications to provide a display that presents sufficiently stable images without unwanted visual artifacts (e.g., blurred and/or distorted scenes) during head motion. By contrast, traditional rolling illumination techniques (e.g., above-described driving schemes used in traditional OLED displays) that do not provide a "burst" of illumination, as defined herein, can cause a manifestation of unwanted visual artifacts during head motion due to the human user's vestibulo-ocular reflex (VOR) as he/she exhibits head motion. Similarly, a 100% duty cycle LED can cause unwanted visual artifacts to appear to a viewing user during head motion. The "rolling burst illumination" techniques described herein mitigate these unwanted visual artifacts and present a sufficiently stable image during head motion, which is desirable in VR and/or AR applications. In fact, the techniques and systems described herein may also find application in "television-sized" displays (e.g., "living room" displays) that utilize fine motion rendition (e.g., sports mode on a television, where an object may quickly traverse the display screen).

By "rolling" the illumination of the light emitting elements across the display (instead of globally flashing all of the light emitting elements simultaneously), display driving circuitry can be re-used to illuminate multiple subsets of the light emitting elements during a given frame, which provides an "affordable" display in terms of the hardware requirements and/or the cost to manufacture the display. This also provides a display whose useful lifespan is much longer than a display where "global flashing" is utilized as a driving scheme. Other benefits provided by the techniques and systems described herein include additional display settling time, and eliminating the need for large vertical blanking interval (i.e., optimizing the utilization of display bandwidth). Furthermore, because the light emitting elements of the disclosed display can be individually-addressable, techniques such as local dimming can be utilized to create a high brightness display with the ability to reproduce a contrast ratio that approximates a close-to-real-world contrast ratio (e.g., upwards of 1,000,000:1 contrast ratio), which is also desirable in VR and/or AR applications. Thus, the disclosed display and driving schemes can be used in VR and/or AR applications (e.g., VR gaming) to provide a more realistic experience to a viewing user who may be playing a game on a VR headset that includes the disclosed display(s).

FIG. 1 is a diagram illustrating an example display 100, or a portion thereof, on the left side of FIG. 1, the display 100 having an array of light emitting elements 102. The diagram of FIG. 1 also illustrates an example graphical diagram on the right side of FIG. 1, the graphical diagram showing a rolling burst illumination driving technique, in accordance with embodiments disclosed herein.

The display 100 may represent any suitable type of emissive display that utilizes light emitting elements 102 (or light sources) to emit light during presentation of image frames (herein referred to as "frames") on the display 100. As an example, the display 100 may comprise a LCD, where the light emitting elements 102 (e.g., LEDs) operate as part of a backlight of the display 100. As another example, the display 100 may comprise an OLED display (or an ILED display), which utilizes the light emitting elements 102 at the pixel-level to emit light at each pixel. Thus, in some embodiments, there may be one light emitting element 102 per pixel. In other embodiments, the display 100 may utilize multiple light emitting elements 102 at each pixel in order to illuminate an individual pixel using multiple light emitting elements 102 for the pixel. In yet other embodiments, such as with a LCD, the light emitting elements 102 may emit light for a group of multiple pixels of the display 100. Therefore, the association of light emitting elements 102 to pixels of the display 100 can be one-to-one, one-to-many, and/or many-to-one.

The light emitting elements 102 may be disposed (e.g., mounted) on a substrate 104 of the display 100, the substrate 104 being formed of one or more layers (e.g., planar, rectangular layers) of material. The substrate 104 may comprise a printed circuit board (PCB), one or more layers of organic material(s), or the like. For instance, the substrate 104 may represent a backlight substrate on which a plurality of light emitting elements 102 are mounted as the backlight of the display 100 (e.g., in the LCD example). Alternatively, the substrate 104 can represent a modulation layer of the display 100 where an array of pixels is disposed, such as a substrate 104 of organic material on silicon, glass, or the like, that is part the modulation layer of an OLED display.

Figure 2:
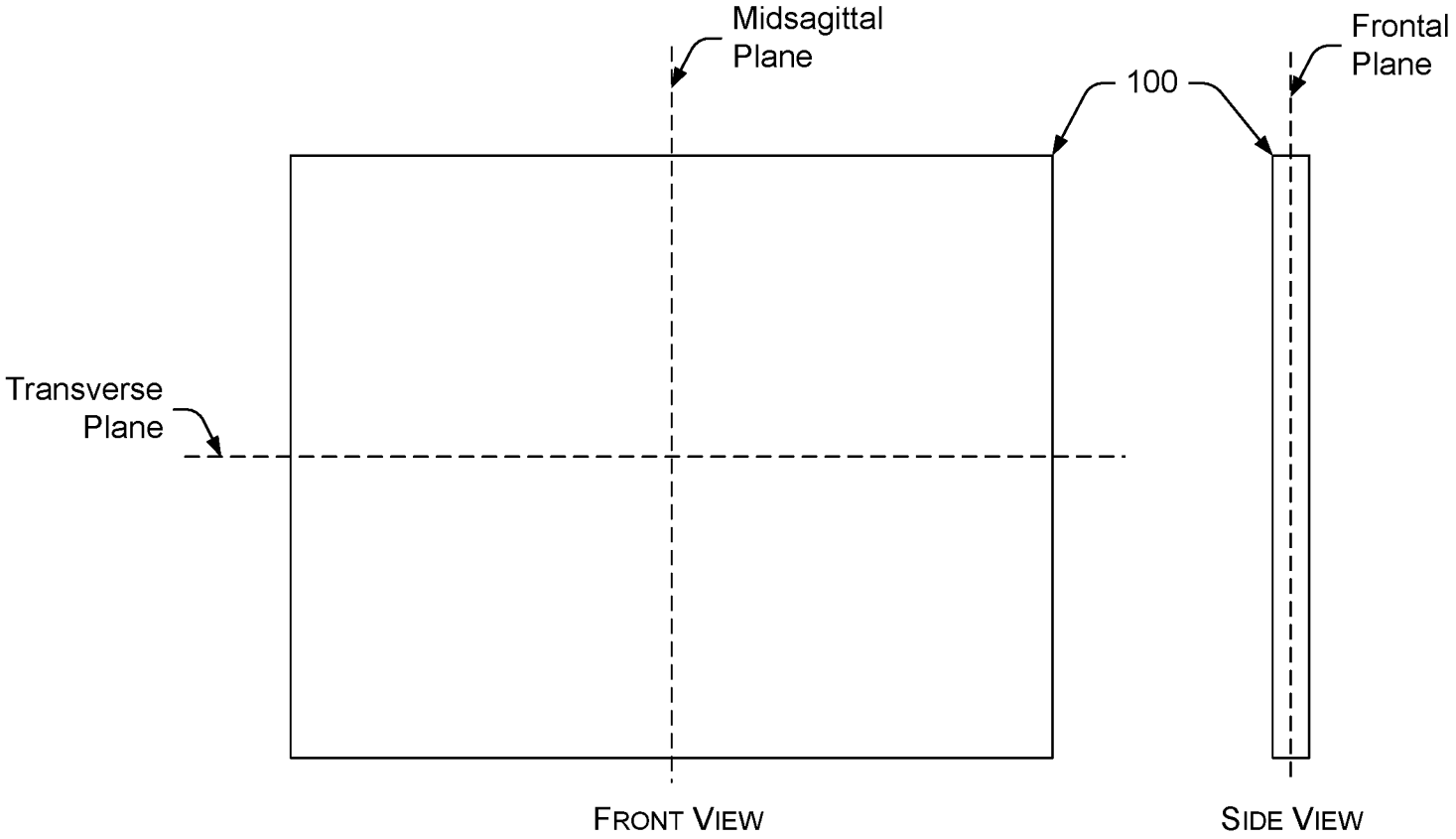
FIG. 2 illustrates the reference planes of the display.

The substrate 104 may be parallel to a frontal plane of the display 100. Turning briefly to FIG. 2, the relative reference planes of the display 100 are illustrated. As shown in FIG. 2, the frontal plane of the display 100 is parallel to a front and back surface of the display 100, as when a user typically looks at the front surface of the display 100 during image presentation. The frontal plane can bisect the display 100 into a front half and a back half. Meanwhile, the midsagittal plane bisects the display 100 in the vertical direction to create a left half and a right half, while the transverse plane bisects the display 100 in the horizontal direction to create a top half and a bottom half Although FIG. 1 depicts a substrate 104 that is parallel to the frontal plane of the display 100, the substrate 104 can alternatively be oriented such that it is parallel to the midsagittal plane and/or the transverse plane of the display 100. This may be utilized for "edge lit" type backlights, where the substrate 104 runs lengthwise along a left, right, top, and/or bottom side of the display 100, and light emitting elements 102 are arranged from top to bottom and/or left to right on the substrate 104. In this implementation, the display 100 may further include one or more diffusers, light guides, and/or waveguides to disperse the light from one or more of the light emitting elements 102 so that it is spread relatively evenly across the viewable area of the display 100.

In FIG. 1, the light emitting elements 102 are shown as being arranged on the substrate 104 in an two-dimensional (2D) array of "M×N" light emitting elements 102 arranged in rows and columns. This is merely one example arrangement of the light emitting elements 102, and it is merely one example arrangement of the light emitting elements 102 in rows and columns. For example, each row may be staggered to create a honeycomb-like pattern of light emitting elements that can still be regarded in rows and columns. Other arrangements are contemplated herein. It is also to be appreciated that the 2D array of light emitting elements 102 is not limiting, as a one-dimensional (1D) array of light emitting elements 102 can also be utilized. For example, each horizontal row of light emitting elements 102 shown in FIG. 1 can include a single light emitting element 102, such that the array of light emitting elements 102 comprises a vertical line of light emitting elements 102. In this implementation, the display 100 may further include one or more diffusers, light guides, and/or waveguides to disperse the light horizontally so that the light substantially spans the width of the display 100. The 1D array of light emitting elements 102 may be mounted on a substrate 104 that is parallel to the frontal plane of the display 100 (e.g., as in a back-lit case), or on a substrate 104 that is parallel to the midsagittal plane of the display (e.g., as in an edge-lit case). In an aspect, a single light emitting element 102 per row may substantially span a width of the display 100 such that light dispersing components are omitted. The 2D array may allow for high dynamic range illumination, which can be beneficial in some display applications.

The light emitting elements 102 may be individually-addressable such that any subset of the light emitting elements 102 can be illuminated independently. Alternatively, the light emitting elements 102 may be addressable in groups, such as horizontally addressable, vertically addressable, or both. As used herein, a "subset" may comprise an individual light emitting element 102 or multiple light emitting elements 102 (e.g., a group of light emitting elements 102). In some embodiments, a subset of light emitting elements 102 includes a row of light emitting elements 102, a column of light emitting elements 102, or the like. Thus, in an aspect of the techniques and systems described herein, subsets of the light emitting elements 102 can be loaded and illuminated in sequence (sequentially), such as by loading and illuminating each row of the light emitting elements 102 in sequence, starting with a first row of the light emitting elements 102 and ending with a last row of the light emitting elements 102. However, any suitable pattern of illumination can be employed using the techniques and systems described herein (e.g., a snake-like pattern of illumination, column-by-column illumination, multiple rows at a time in sequence, etc.).

The display 100, or the system in which the display 100 is implemented, may include, among other things, one or more display controllers 106, and display driver circuitry 108. The display driver circuitry 108 may be coupled to the array of light emitting elements 102 via conductive paths, such as metal traces, on the substrate 104 and/or on a flexible printed circuit. FIG. 1 shows an example where the conductive paths are arranged in substantially horizontal lines and substantially vertical lines on the substrate 104 so that the display driver circuitry 108 is configured to address an individual light emitting element 102 of the array via a pair of a horizontal line and a vertical line that intersects at the individual light source 102. The display controller(s) 106 may be mounted on a main logic board of an electronic device in which the display 100 is embedded, such as a motherboard, and may be communicatively coupled to the display driver circuitry 108 and configured to provide signals, information, and/or data to the display driver circuitry 108. The signals, information, and/or data received by the display driver circuitry 108 may cause the display driver circuitry 108 to illuminate the light emitting elements 102 in a particular way. That is, the display controller(s) 106 may determine which light emitting element(s) 102 is to be illuminated, when the element(s) 102 is to illuminate, and the level of light output that is to be emitted by the light emitting element(s) 102, and may communicate the appropriate signals, information, and/or data to the display driver circuitry 108 in order to accomplish that objective.

The display driver circuitry 108 may include one or more integrated circuits (ICs) or similar components configured to load individual subsets of the light emitting elements 102 with light output data received from the display controller(s) 106. In an OLED or ILED display, the display driver circuitry may include a thin film transistor (TFT) at each pixel for controlling the application of a signal to the OLED/ILED at the pixel-level. When a given subset of light emitting elements 102 are loaded, each light emitting element 102 of the subset may be loaded with particular light output data that corresponds to an amount of light that is to be emitted from the light emitting element 102 during illumination of the light emitting element 102. Thus, each light emitting element 102 of a subset of light emitting elements 102 (e.g., a row of light emitting elements 102) may be loaded independently with light output data that is particular to that light emitting element, even if the subset of light emitting elements 102 are loaded with light output data contemporaneously. The light output data may be in the form of a digital numerical value that corresponds to a level of light output that is to be emitted. Thus, the light emitting elements 102 can be controlled to emit light at varying levels of brightness on an element-by-element basis, which allows for techniques such as local dimming to provide a suitably high contrast ratio.

FIG. 1 shows the display controller(s) 106 as including a load controller 110 and an illumination controller 112. The load controller 110 may be configured to cause the display driver circuitry 108 to load individual subsets of the light emitting elements 102 in sequence (sequentially) with light output data that corresponds to the amount of light to be emitted from each light emitting element 102. This sequential loading process may load the light emitting elements 102, in sequence, subset-by-subset, with the light output data, for any suitable breakdown of the light emitting elements 102 into subsets. For example, a row-by-row breakdown may cause loading of each row of the light emitting elements 102 with light output data in sequence, starting with a first row (e.g., row #1 at the top of the display 100) and ending with a last row (e.g., row # N at the bottom of the display 100). Again, it is to be appreciated that a subset can include a single light emitting element 102 (e.g., a single light emitting element 102 per row), such that the sequential loading proceeds element-by-element.

The illumination controller 112 may be configured to cause the display driver circuitry 108 to illuminate the individual subsets of the light emitting elements 102 in sequence (sequentially), but at a faster rate than the rate at which the individual subsets of the light emitting elements 102 were sequentially loaded with light output data. In some embodiments, the illumination controller 112 is configured to wait a predefined time period since the first subset of the light emitting elements 102 starts loading with the light output data before causing the display driver circuitry 108 to start illuminating the first subset of the light emitting elements 102, which allows the sequential illumination to occur over a shorter time period than the loading time period. The graphical diagram on the right side of FIG. 1 shows an example of this "rolling burst illumination" technique in a particular case where the subsets of light emitting elements 102 represent individual rows of light emitting elements 102 (e.g., rows 1-N).

Consider an example where the display 100 has a particular refresh rate. The "refresh rate" of a display is the number of times per second the display can redraw the screen. The number of frames displayed per second may be limited by the refresh rate of the display. Thus, a series of frames may be processed and displayed on the display such that a single frame of the series of frames is displayed with every screen refresh. That is, in order to present a series of images on the display 100, the display 100 transitions from frame-to-frame, in the series of frames, at the refresh rate of the display.

The series of frames may represent images of a game that a user of the display 100 is playing (e.g., on a VR headset), but this disclosure is not limited to a gaming application. Any suitable refresh rate can be utilized, such as a 90 Herz (Hz) refresh rate. Each frame of the series of frames is processed, in sequence, where each subset of light emitting elements 102 is illuminated once (not multiple times) per frame. The graphical diagram on the right of FIG. 1 shows the rows 1-N of the display 100 on the vertical axis, and time on the horizontal axis to illustrate the example technique of loading and illuminating the light emitting elements 102 sequentially, row-by-row, during the processing of a given frame. It is to be appreciated that the row-by-row breakdown is merely one example in which the array of light emitting elements 102 can be broken down into subsets, and the examples described herein can be implemented with other types of subsets (e.g., other groupings of light emitting elements 102, including individual light emitting elements 102) without departing from the basic principles of the techniques described herein.

In FIG. 1, the starting time at which the display 100 begins processing frame "F" ("F" being any integer corresponding to a frame in the series of frames) is shown. When the display starts processing frame F, the load controller 110 may, at 114, cause the display driver circuitry 108 to start loading individual subsets (e.g., rows) of the light emitting elements 102 in sequence, with light output data, at a first rate 116, and starting with a first subset of the light emitting elements 102. The first rate 116 at which the individual subsets of light emitting elements 102 are sequentially loaded with light output data is indicated by the slope (i.e., rise over run) of the "load frame F" line. Thus, the loading process (from start to finish) may occur over a loading time period measured from a time of starting to load the first subset (e.g., row #1 at the top of the display 100) of the light emitting elements 102 with the light output data to a time of starting to load the last subset (e.g., row # N at the bottom of the display 100) of the light emitting elements 102 with the light output data.

At 118, instead of immediately commencing the illumination process at the first subset (e.g., row #1) after the first subset is loaded with light output data, the illumination controller 112 may be configured to wait a predefined time period since the first subset (e.g., row #1) of the light emitting elements 102 starts loading with the light output data before starting the illumination process at 120 (Step 3). Waiting a predefined time period at 118 allows the illumination process to transpire (from start to finish) at a second rate 122 that is higher (or faster) than the first rate 116. This provides a rolling "burst" of illumination by waiting a predefined time period and then illuminating the light emitting elements 102 (once, not multiple times, per frame) sequentially over a shorter period of time than the time it took to load the light emitting elements 102 with light output data.

The predefined time period may be of any suitable length of time, so long as it is less than the frame time (the total time to process the frame), less than the loading time period (the total time to load the light emitting elements 102 with light output data), and allows enough time to illuminate the light emitting elements 102 at the second rate 122. Consider an example where the refresh rate is 90 Hz. A frame time to process frame F is derivable from the refresh rate based on the assumption that the number of frames displayed per second is equal to the refresh rate of the display (e.g., 1000 milliseconds (ms)÷90 frames per second (FPS)=~11 ms). In this 90 Hz refresh rate example, the loading time period—measured from a time of starting to load the first subset (e.g., row #1 at the top of the display 100) with light output data to a time of starting to load the last subset (e.g., row # N at the bottom of the display 100) with light output data—may consume most of the total frame time of 11 ms. For example, the loading time period may be no less than about 99% of the frame time (e.g., 11 ms) of frame F. In this example, the predefined time period that the illumination controller 112 waits at 118 before starting the illumination process at 120 may be within a range of about 1 ms to 10 ms. The predefined time period at 118 may vary by implementation and may depend on how fast the illumination process can occur (i.e., it may depend on the upper limits of the second rate 122 at which the subsets of the light emitting elements 102 can be sequentially illuminated). In some embodiments, the predefined time period at 118 may be at least about 1 ms, at least about 3 ms, at least about 5 ms, at least about 7 ms, at least about 9 ms, or at least about 10 ms.

At 120, after waiting the predefined time period, the illumination controller 112 may cause the display driver circuitry to start illuminating the individual subsets (e.g., rows) of the light emitting elements 102 in the sequence and in accordance with the light output data. As mentioned, the illumination process may occur at the second rate 122 indicated by the slope (i.e., rise over run) of the "illuminate frame F" line in FIG. 1. A steeper slope of the "illuminate frame F" line corresponds to a faster burst of rolling illumination. However, the limitation of the display driver circuitry 108 and other components may dictate how steep of a slope of the "illuminate frame F" line is attainable. A steeper slope (and hence a faster second rate 122) may provide the most mitigation of unwanted visual artifacts in the displayed images/scenes when head movement is exhibited by the viewing user. In any case, the light emitting elements 102 are illuminated over an illumination time period measured from a time of starting to illuminate a first subset (e.g., row #1 at the top of the display 100) of the light emitting elements 102 to a time of starting to illuminate a last subset (E.g., row # N at the bottom of the display 100) of the light emitting elements 102, and this illumination time period may be less than the loading time period, and may be within a range of about 2% to 80% of the frame time of the frame (e.g., frame F). It is to be appreciated that both the "load frame F" line and the "illuminate frame F" line in FIG. 1 represent the time at which the respective operations are started at each subset (e.g., row) of the light emitting elements 102, and that the respective operations may be carried out over a time period. For example, After starting the illumination at a given row of the display 100, the row of light emitting elements 102 may be illuminated for a period of time, such that the end of the illumination could be represented by an additional line after the "illuminate frame F" line and having the same slope as the "illuminate frame F" line. It is also to be appreciated that the "illuminate frame F" line occurs once for frame F, and there are no additional passes of rolling illumination during the single frame.

As shown in FIG. 1, the loading process and the illumination process may overlap. For example, the start of the illumination process at 120 may begin before completion of the loading process. Furthermore, a next fame (e.g., frame "F+1") may begin its loading process at 124 before completion of the illumination process of frame F. Thus, the processing of frames may overlap such that the display 100 may begin processing frame F+1 before it finishes processing frame F. This can conserve bandwidth consumption of the display 100 because 100% of the display bandwidth can be directed towards displaying images in the display 100 (e.g., there is no wasted display bandwidth where the display 100 is presenting "black").

Figure 3:
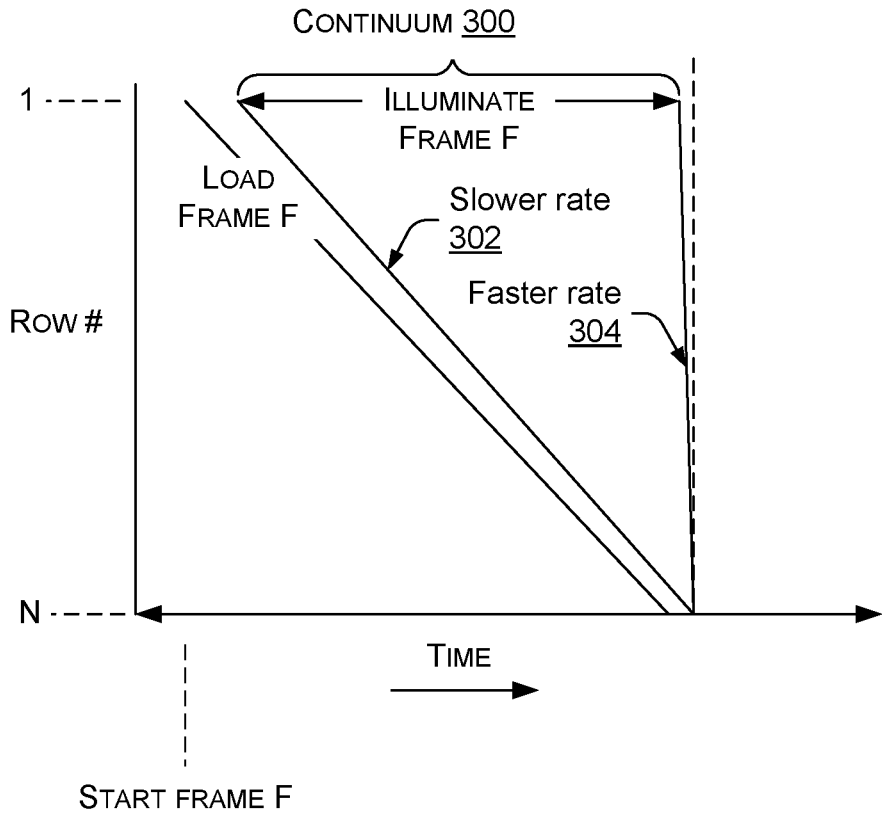
FIG. 3 is a graphical diagram illustrating a continuum of different illumination rates that may be implemented, in accordance with embodiments disclosed herein.

FIG. 3 is a graphical diagram illustrating a continuum 300 of different illumination rates that may be implemented, in accordance with embodiments disclosed herein. In particular, a continuum 300 of illumination rates can be within a range of a slower rate 302 that is slightly greater (faster) than the loading rate (i.e., the slope of the "load frame F" line) to a faster rate 304 that is slightly less than a vertical slope. The slower rate 302 may represent a slowest illumination rate that is suitable (e.g., where the illumination time period is about 80% of the frame time), and where this slowest illumination rate is not equal to the loading rate (i.e., the illumination time period is less than the loading time period by a small difference, such as a difference of a few (e.g., 1-3) microseconds). The faster rate 304 may represent a fastest illumination rate that is suitable (e.g., where the illumination time period is about 2% of the frame time), and where the fastest illumination rate is not equal to the loading rate (i.e., the illumination time period is less than the loading time period by a large difference, such as a difference of several (e.g., 10) milliseconds). Another way to think of this is the slower rate 302 may provide a slower burst of rolling illumination corresponding to a longer illumination time period, and the faster rate 304 may provide a faster burst of rolling illumination corresponding to a shorter illumination time period. The implemented illumination rate may depend on the hardware constraints of the system, the refresh rate of the display 100, etc. If very responsive circuitry is available, a faster rate 304 may be achievable to provide the most mitigation of unwanted visual artifacts. A goal may be to minimize the total illumination time period for a given frame, but to still control the illumination in a sequential manner, as described herein.

Figure 4:
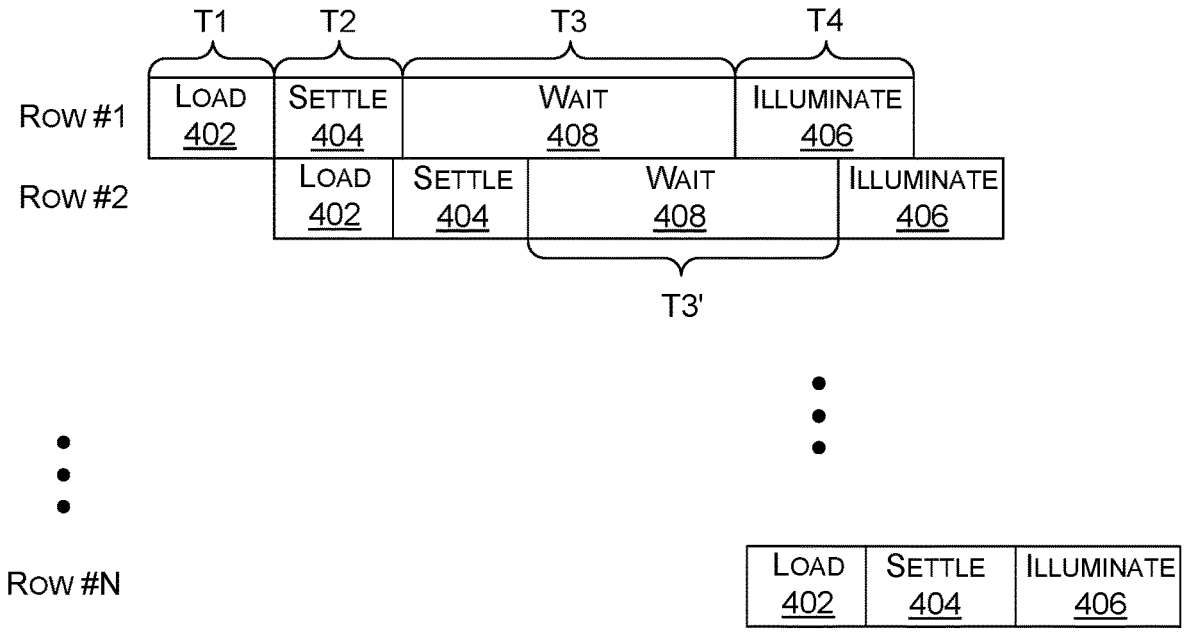
FIG. 4 is a diagram illustrating example time periods where different operations are performed with respect to a subset of light emitting elements during a frame.

FIG. 4 is a diagram illustrating example time periods where different operations are performed with respect to a subset of light emitting elements 102 during a frame. Continuing with the example where subsets of the light emitting elements 102 represent rows of the light emitting elements 102, the array of light emitting elements 102 may be arranged in rows of one or more light emitting elements 102 in each row. FIG. 4 shows rows 1-N, which may represent a top-to-bottom arrangement of rows on the display 100. Again, it is to be appreciated that a row-by-row illumination sequence is merely one illustrative example way of breaking the array of light emitting elements 102 up into subsets, and any pattern of illumination can be employed with different subsets of light emitting elements 102 without departing from the techniques described herein.

When the loading process commences during a frame (e.g., frame F), as described herein, the first subset (e.g., row #1 at the top of the display 100) of light emitting elements 102 may be loaded with light output data. This is represented by the load operation 402 at row #1 in FIG. 4, which transpires over time period, T1. After completion of the load operation 402 for row #1, the next subset (e.g., row #2) of light emitting elements 102 may begin loading with light output data. This is represented by the load operation 402 at row #2 in FIG. 4. The load operation 402 at row #2 may transpire over the same time period, T1. This continues in sequence so that the individual subsets (e.g., rows) of light emitting elements 102 are loaded in sequence with light output data. The "load frame F" line of FIG. 1 represents the beginning of the time period, T1, for each row in FIG. 4.

FIG. 4 also illustrates other operations that occur after the load operation 402 at individual ones of the rows, such as a settle operation 404, and an illuminate operation 406. A "wait" period 408 may occur between the settle operation 404 and the illuminate operation 406 at individual ones of the rows. For example, in row #1, after the light emitting elements 102 are loaded with light output data, there may be settling time period, T2, for the light emitting elements 102 to settle after the load operation 402. If the light emitting elements 102 are illuminated before completion of the settling time period, T2, there may be color or gamma rendition gradients on the display for those light emitting elements 102 that have not been given enough time to settle after loading. In row #1, after completion of the settle operation 404, there is a "wait" period 408, T3, before the illuminate operation 406 commences. The illumination operation 406 at row #1 may represent the start of the illumination process for the given frame, and this illumination process may commence after a predefined period of time since starting the load operation 402. For example, the predefined time period 118, referenced in FIG. 1 may represent a time period between the start of T1 and the start of T4 for the first row (row #1) shown in FIG. 4. The time period, T3, between the settling operation 404 and the illumination operation 406 for a given subset is to illustrate a further breakdown of the sub-operations at each subset of light emitting elements 102. By waiting the time period, T3, before illuminating the light emitting elements 102 of row #1, the sequential illumination may proceed at a faster rate, row-by-row, as compared to the rate at which the light emitting elements 102 are loaded in sequence, row-by-row. The wait time period 408, T3', at row #2 is less than the wait time period 408, T3, at row #1. In fact, the wait time period 408 for a given row is less than the wait time period 408 for the previous row. This is because the illumination rate is faster than the load rate. At each row, the light emitting elements 102 may emit light for a period of time, T4, during the illuminate operation 406. This period of time may be on the order of 1 ms. FIG. 4 also shows an example where there is no wait period for the last row # N. In other words, the illuminate operation 406 at row # N commences as soon as the settle operation 404 finishes.

The processes described herein are illustrated as a collection of blocks in a logical flow graph, which represent a sequence of operations that can be implemented in hardware, software, or a combination thereof. In the context of software, the blocks represent computer-executable instructions that, when executed by one or more processors, perform the recited operations. Generally, computer-executable instructions include routines, programs, objects, components, data structures, and the like that perform particular functions or implement particular abstract data types. The order in which the operations are described is not intended to be construed as a limitation, and any number of the described blocks can be combined in any order and/or in parallel to implement the processes.

Figure 5:
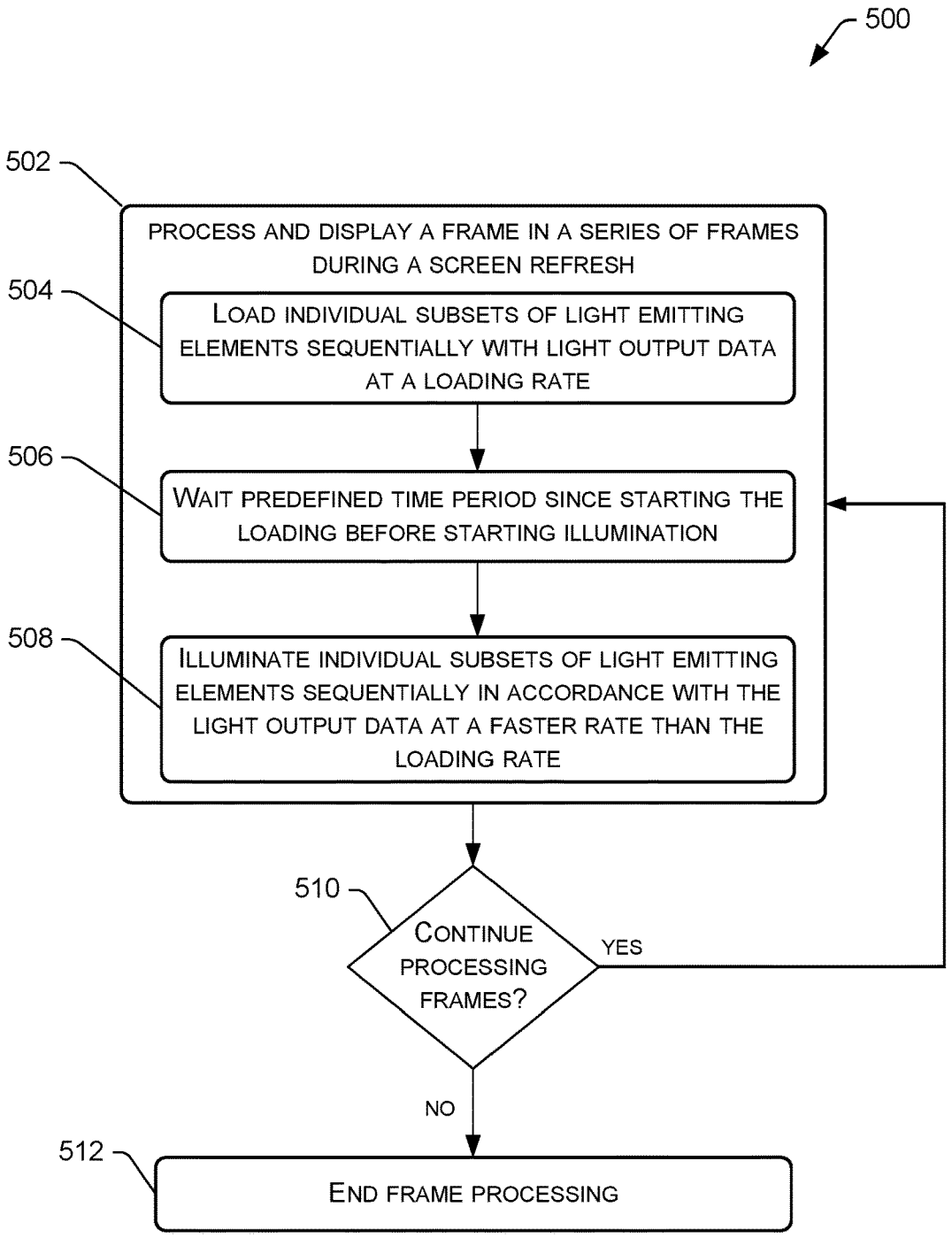
FIG. 5 is a flow diagram of an example process for driving a display using a rolling burst illumination driving technique, in accordance with embodiments disclosed herein.

FIG. 5 is a flow diagram of an example process 500 for driving a display using a rolling burst illumination driving technique, in accordance with embodiments disclosed herein. For discussion purposes, the process 500 is described with reference to the previous figures.

At 502, a frame in a series of frames may be processed and displayed by an electronic device that includes a display 100. The frame may be processed as part of a screen refresh of the display 100 having a particular refresh rate. The series of frames, when processed, may present images on the display 100 at the refresh rate of the display 100. For example, a 90 Hz display 100 may process 90 frames per second. The display 100 on which the images are presented during frame processing may include an array of light emitting elements 102 (e.g., LEDs) arranged on a substrate 104 that is parallel to a frontal plane of the display 100. Blocks 504-508 may represent sub-operations of block 502 during the processing of a frame.

At 504, one or more controllers (e.g., display controller(s) 106, such as the load controller 110) may cause display driver circuitry 108 to load individual subsets of the light emitting elements 102 sequentially (or in sequence) with light output data. The loading process at 504 for the given frame (or screen refresh) may occur at a loading rate (e.g., the first rate 116 of FIG. 1). The loading process at 504 for the given frame (or screen refresh) may also occur over a loading time period measured from a time of starting to load the first subset (e.g., a first row) of the light emitting elements 102 with the light output data to a time of starting to load the last subset (e.g., a last row) of the light emitting elements 102 with the light output data.

At 506, the one or more controllers (e.g., display controller(s) 106, such as the illumination controller 112) may wait a predefined time period (e.g., the predefined time period at 118 of FIG. 1) since the first subset of the light emitting elements 102 starts loading with the light output data at block 504 before causing the display driver circuitry to start illuminating the first subset of the light emitting elements 102 at block 508.

At 508, the one or more controllers (e.g., display controller(s) 106, such as the illumination controller 112) may cause the display driver circuitry 108 to illuminate the individual subsets of the light emitting elements 102 sequentially (or in the sequence) and in accordance with the light output data. The illumination process at 508 for the given frame (or screen refresh) may occur at a faster rate than the loading rate (e.g., the second rate 122 of FIG. 1). The illumination process at 508 for the given frame (or screen refresh) may also occur over an illumination time period measured from a time of starting to illuminate a first subset (e.g., a first row) of the light emitting elements 102 to a time of starting to illuminate a last subset (e.g., a last row) of the light emitting elements 102. The rate at which the light emitting elements 102 are sequentially illuminated at block 508 may be a relatively fast rate, such that the illumination time period of the frame is within a range of about 2% to 80% of a frame time of the frame, the frame time derivable form the refresh rate. In an example where the refresh rate is 90 Hz, the frame time is approximately 11 ms. In this example, the illumination time period at block 506 may be no greater than about 8.8 ms, and no less than about 0.22 ms. The loading time period at block 504 is also greater than the illumination time period at block 508. For instance, in the running example of a 90 Hz display, the loading time period may be at least about 10.5 ms, which is greater than 8.8 ms. Moreover, the illumination process 508 occurs once per frame (e.g., the light emitting elements 102 are illuminated at block 508 once (not multiple times) for the given frame).

In some embodiments, the illumination time period of the frame is no greater than about 80% of the frame time, no greater than about 60% of the frame time, no greater than about 40% of the frame time, no greater than about 20% of the frame time, no greater than about 10% of the frame time, no greater than about 5% of the frame time, or no greater than about 4% of the frame time. In some embodiments, the illumination time period of the frame is at least about 2% of the frame time, at least about 4% of the frame time, at least about 6% of the frame time, at least about 10% of the frame time, at least about 20% of the frame time, at least about 40% of the frame time, or at least about 70% of the frame time.

At block 510, the electronic device including the display 100 may determine whether to continue processing frames of the series of frames. If a next frame is to be processed, the process 500 can iterate by following the "yes" route from block 510 to block 502 and by processing the next frame in the series of frames at block 502. If a next frame is not to be processed, the process 500 may end frame processing at block 512.

Figure 6:
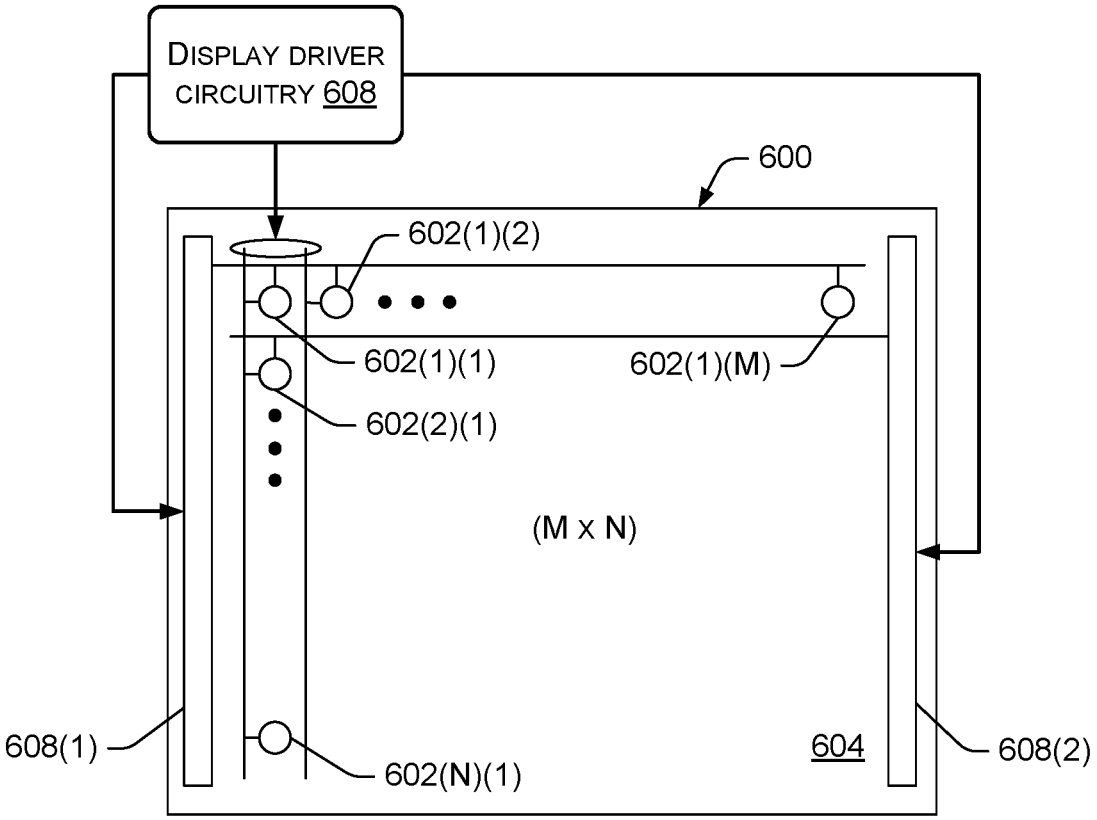
FIG. 6 is a diagram illustrating an example display configured to implement a cross-fading technique as part of a rolling burst illumination driving technique, in accordance with embodiments disclosed herein.

FIG. 6 is a diagram illustrating an example display 600 configured to implement a cross-fading technique as part of a rolling burst illumination driving technique, in accordance with embodiments disclosed herein. The display 600 shown in FIG. 6 may be similar to the display 100 described herein and introduced with reference to FIG. 1. For example, the display 600 may include an array of light emitting elements 602 arranged (e.g., mounted) on a substrate 604 that is parallel to a frontal plane of the display 600, as well as display driver circuitry 608 coupled to the array of light emitting elements 602 via conductive paths, and configured to receive signals, information, and/or data from one or more controllers for driving the light emitting diodes to emit light during the processing of frames to present images on the display 600.

Notably, the display driver circuitry 608 of the display 600 includes first display driver circuitry 608(1) coupled to some, but not all, of the rows of the light emitting elements 602. For example, the first display driver circuitry 608(1) may be coupled to odd-numbered rows (e.g., rows 1, 3, 5, etc.) of the light emitting elements 602 via the conductive paths. The display driver circuitry 608 of the display 600 may further include second display driver circuitry 608(2) coupled to some, but not all, of the rows of the light emitting elements 602. For example, the second display driver circuitry 608(2) may be coupled to even-numbered rows (e.g., rows 2, 4, 6, etc.) of the light emitting elements 602 via the conductive paths. This display driver circuitry 608 configuration can enable a cross-fading technique where the illumination of a first row (e.g., an odd-numbered row) of light emitting elements 602 can be faded out while a next, second row (e.g., an even-numbered row) of light emitting elements 602 is faded in. For example, the first display driver circuitry 608(1) may be configured to load and illuminate—at blocks 504 and 508, respectively, of the process 500—the odd-numbered rows of the light emitting elements 602 sequentially, and the second display driver circuitry 608(2) may be configured to load and illuminate—at blocks 504 and 508, respectively, of the process 500—the even-numbered rows of the light emitting elements 602 sequentially. Because different display driver circuitry 608(1) and 608(2) is used to drive the odd-numbered and even-numbered rows of light emitting elements 602, respectively, the loading and illuminating operations of the respective sets of rows can overlap in time. For instance, given a pair of an odd-numbered row and an even-numbered row of light emitting elements 602, the light emitting elements 602 of the even-numbered row (e.g., row #2) can start illuminating after the light emitting elements 602 of the odd-numbered row (e.g., row #1) start illuminating, and in this way, light emitted from the light emitting elements 602 of the even-numbered row (e.g., row #2) can fade in while light emitted from the light emitting elements 602 of the odd-numbered row (e.g., row #1) fades out. This cross-fading technique may further mitigate unwanted visual artifacts from manifesting in a scene during head movement of the viewing user. Although the example of FIG. 6, like FIG. 1, shows a 2D array of light emitting elements 602, it is to be appreciated that the techniques described herein (e.g., those described with reference to FIG. 6) are also applicable to 1D arrays of light emitting elements 602.

Figure 7:
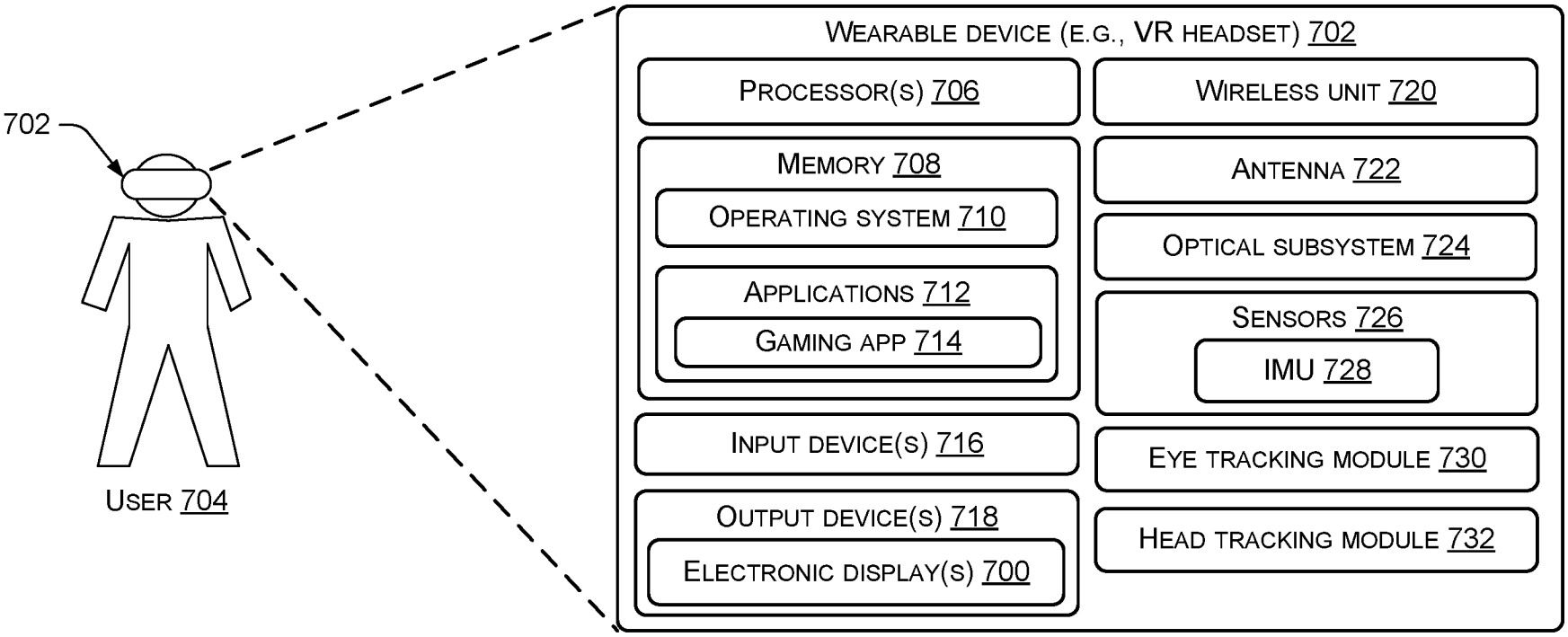
FIG. 7 illustrates example components of a wearable device, such as a VR headset, in which a display according to the embodiments disclosed herein may be embedded.

FIG. 7 illustrates example components of a wearable device 702, such as a VR headset, in which a display 700 according to the embodiments disclosed herein may be embedded. The wearable device 702 may be implemented as a standalone device that is to be worn by a user 704 (e.g., on a head of the user 704). In some embodiments, the wearable device 702 may be head-mountable, such as by allowing a user 704 to secure the wearable device 702 on his/her head using a securing mechanism (e.g., an adjustable band) that is sized to fit around a head of a user 702. In some embodiments, the wearable device 702 comprises a virtual reality (VR) or augmented reality (AR) headset that includes a near-eye or near-to-eye display(s). As such, the terms "wearable device", "wearable electronic device", "VR headset", "AR headset", and "head-mounted display (HMD)" may be used interchangeably herein to refer to the device 702 of FIG. 7. However, it is to be appreciated that these types of devices are merely example of a wearable device 702, and it is to be appreciated that the wearable device 702 may be implemented in a variety of other form factors.

In the illustrated implementation, the wearable device 702 includes one or more processors 706 and memory 708 (e.g., computer-readable media 708). In some implementations, the processors(s) 706 may include a central processing unit (CPU), a graphics processing unit (GPU), both CPU and GPU, a microprocessor, a digital signal processor or other processing units or components known in the art. Alternatively, or in addition, the functionally described herein can be performed, at least in part, by one or more hardware logic components. For example, and without limitation, illustrative types of hardware logic components that can be used include field-programmable gate arrays (FPGAs), application-specific integrated circuits (ASICs), application-specific standard products (ASSPs), system-on-a-chip systems (SOCs), complex programmable logic devices (CPLDs), etc. Additionally, each of the processor(s) 702 may possess its own local memory, which also may store program modules, program data, and/or one or more operating systems.

The memory 708 may include volatile and nonvolatile memory, removable and non-removable media implemented in any method or technology for storage of information, such as computer-readable instructions, data structures, program modules, or other data. Such memory includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, RAID storage systems, or any other medium which can be used to store the desired information and which can be accessed by a computing device. The memory 708 may be implemented as computer-readable storage media ("CRSM"), which may be any available physical media accessible by the processor(s) 706 to execute instructions stored on the memory 708. In one basic implementation, CRSM may include random access memory ("RAM") and Flash memory. In other implementations, CRSM may include, but is not limited to, read-only memory ("ROM"), electrically erasable programmable read-only memory ("EEPROM"), or any other tangible medium which can be used to store the desired information and which can be accessed by the processor(s) 706.

Several modules such as instruction, datastores, and so forth may be stored within the memory 708 and configured to execute on the processor(s) 706. A few example functional modules are shown as applications stored in the memory 708 and executed on the processor(s) 706, although the same functionality may alternatively be implemented in hardware, firmware, or as a system on a chip (SOC).

An operating system module 710 may be configured to manage hardware within and coupled to the wearable device 702 for the benefit of other modules. In addition, in some instances the wearable device 702 may include one or more applications 712 stored in the memory 708 or otherwise accessible to the wearable device 702. In this implementation, the application(s) 712 includes a gaming application 714. However, the wearable device 702 may include any number or type of applications and is not limited to the specific example shown here. The gaming application 714 may be configured to initiate gameplay of a video-based, interactive game (e.g., a VR game) that is playable by the user 704.

Generally, the wearable device 702 has input devices 716 and output devices 718. The input devices 716 may include control buttons. In some implementations, one or more microphones may function as input devices 716 to receive audio input, such as user voice input. In some implementations, one or more cameras or other types of sensors (e.g., inertial measurement unit (IMU)) may function as input devices 716 to receive gestural input, such as a hand and/or head motion of the user 704. In some embodiments, additional input devices 716 may be provided in the form of a keyboard, keypad, mouse, touch screen, joystick, and the like. In other embodiments, the wearable device 702 may omit a keyboard, keypad, or other similar forms of mechanical input. Instead, the wearable device 702 may be implemented relatively simplistic forms of input device 716, a network interface (wireless or wire-based), power, and processing/memory capabilities. For example, a limited set of one or more input components may be employed (e.g., a dedicated button to initiate a configuration, power on/off, etc.) so that the wearable device 702 can thereafter be used. In one implementation, the input device(s) 716 may include control mechanisms, such as basic volume control button(s) for increasing/decreasing volume, as well as power and reset buttons.

The output devices 718 may include a display 700, a light element (e.g., LED), a vibrator to create haptic sensations, a speaker(s) (e.g., headphones), and/or the like. There may also be a simple light element (e.g., LED) to indicate a state such as, for example, when power is on. The electronic display(s) 700 shown in FIG. 7 may function as output devices 718 to output visual/graphical output, and the electronic display(s) 700 may correspond to the display(s) 100, 600 described herein.

The wearable device 702 may further include a wireless unit 720 coupled to an antenna 722 to facilitate a wireless connection to a network. The wireless unit 720 may implement one or more of various wireless technologies, such as Wi-Fi, Bluetooth, radio frequency (RF), and so on. It is to be appreciated that the wearable device 702 may further include physical ports to facilitate a wired connection to a network, a connected peripheral device, or a plug-in network device that communicates with other wireless networks.

The wearable device 702 may further include optical subsystem 724 that directs light from the electronic display 700 to a user's eye(s) using one or more optical elements. The optical subsystem 724 may include various types and combinations of different optical elements, including, without limitations, such as apertures, lenses (e.g., Fresnel lenses, convex lenses, concave lenses, etc.), filters, and so forth. In some embodiments, one or more optical elements in optical subsystem 724 may have one or more coatings, such as anti-reflective coatings. Magnification of the image light by optical subsystem 724 allows electronic display 700 to be physically smaller, weigh less, and consume less power than larger displays. Additionally, magnification of the image light may increase a FOV of the displayed content (e.g., images). For example, the FOV of the displayed content is such that the displayed content is presented using almost all (e.g., 120-150 degrees diagonal), and in some cases all, of the user's FOV. AR applications may have a narrower FOV (e.g., about 40 degrees FOV). Optical subsystem 724 may be designed to correct one or more optical errors, such as, without limitation, barrel distortion, pincushion distortion, longitudinal chromatic aberration, transverse chromatic aberration, spherical aberration, comatic aberration, field curvature, astigmatism, and so forth. In some embodiments, content provided to electronic display 700 for display is pre-distorted, and optical subsystem 724 corrects the distortion when it receives image light from electronic display 700 generated based on the content.

The wearable device 702 may further include one or more sensors 726, such as sensors used to generate motion, position, and orientation data. These sensors 726 may be or include gyroscopes, accelerometers, magnetometers, video cameras, color sensors, or other motion, position, and orientation sensors. The sensors 726 may also include subportions of sensors, such as a series of active or passive markers that may be viewed externally by a camera or color sensor in order to generate motion, position, and orientation data. For example, a VR headset may include, on its exterior, multiple markers, such as reflectors or lights (e.g., infrared or visible light) that, when viewed by an external camera or illuminated by a light (e.g., infrared or visible light), may provide one or more points of reference for interpretation by software in order to generate motion, position, and orientation data.

In an example, the sensor(s) 726 may include an inertial measurement unit (IMU) 728. IMU 728 may be an electronic device that generates calibration data based on measurement signals received from accelerometers, gyroscopes, magnetometers, and/or other sensors suitable for detecting motion, correcting error associated with IMU 728, or some combination thereof. Based on the measurement signals such motion-based sensors, such as the IMU 728, may generate calibration data indicating an estimated position of wearable device 702 relative to an initial position of wearable device 702. For example, multiple accelerometers may measure translational motion (forward/back, up/down, left/right) and multiple gyroscopes may measure rotational motion (e.g., pitch, yaw, and roll). IMU 728 can, for example, rapidly sample the measurement signals and calculate the estimated position of wearable device 702 from the sampled data. For example, IMU 728 may integrate measurement signals received from the accelerometers over time to estimate a velocity vector and integrates the velocity vector over time to determine an estimated position of a reference point on wearable device 702. The reference point is a point that may be used to describe the position of wearable device 702. While the reference point may generally be defined as a point in space, in various embodiments, reference point is defined as a point within wearable device 702 (e.g., a center of the IMU 728). Alternatively, IMU 728 provides the sampled measurement signals to an external console (or other computing device), which determines the calibration data.

The sensors 726 may operate at relatively high frequencies in order to provide sensor data at a high rate. For example, sensor data may be generated at a rate of 1000 Hz (or 1 sensor reading every 1 millisecond), In this way, one thousand readings are taken per second. When sensors generate this much data at this rate (or at a greater rate), the data set used for predicting motion is quite large, even over relatively short time periods on the order of the tens of milliseconds.

The wearable device 702 may further include an eye tracking module 730. A camera or other optical sensor inside wearable device 702 may capture image information of a user's eyes, and eye tracking module 730 may use the captured information to determine interpupillary distance, interocular distance, a three-dimensional (3D) position of each eye relative to wearable device 702 (e.g., for distortion adjustment purposes), including a magnitude of torsion and rotation (i.e., roll, pitch, and yaw) and gaze directions for each eye. In one example, infrared light is emitted within wearable device 702 and reflected from each eye. The reflected light is received or detected by a camera of the wearable device 702 and analyzed to extract eye rotation from changes in the infrared light reflected by each eye. Many methods for tracking the eyes of a user 704 can be used by eye tracking module 730. Accordingly, eye tracking module 730 may track up to six degrees of freedom of each eye (i.e., 3D position, roll, pitch, and yaw) and at least a subset of the tracked quantities may be combined from two eyes of a user 704 to estimate a gaze point (i.e., a 3D location or position in the virtual scene where the user is looking). For example, eye tracking module 730 may integrate information from past measurements, measurements identifying a position of a user's 704 head, and 3D information describing a scene presented by electronic display 704. Thus, information for the position and orientation of the user's 704 eyes is used to determine the gaze point in a virtual scene presented by wearable device 702 where the user 704 is looking.

The wearable device 702 may further include a head tracking module 732. The head tracking module 732 may leverage one or more of the sensor 726 to track head motion of the user 704, as described above.

Although the subject matter has been described in language specific to structural features, it is to be understood that the subject matter defined in the appended claims is not necessarily limited to the specific features described. Rather, the specific features are disclosed as illustrative forms of implementing the claims.

What is claimed is:

1. A display comprising:

an array of light emitting elements arranged on a substrate that is parallel to a frontal plane of the display in rows and columns, wherein the rows of the light emitting elements include respective sets of rows comprising a first set of odd-numbered rows and a second set of even-numbered rows;

display driver circuitry coupled to the array of light emitting elements via conductive paths, the display driver circuitry including:

first display driver circuitry coupled to the odd-numbered rows of the light emitting elements via the conductive paths; and second display driver circuitry coupled to the even-numbered rows of the light emitting elements via the conductive paths; and one or more controllers to:

for a frame of a series of frames that present images on the display, cause performance of loading and illuminating operations for the respective sets of rows by:

causing the first display driver circuitry to load the odd-numbered rows of the light emitting elements sequentially with first light output data at a first rate;

causing the second display driver circuitry to load the even-numbered rows of the light emitting elements sequentially with second light output data at the first rate;

causing the first display driver circuitry to illuminate the odd-numbered rows of the light emitting elements sequentially and in accordance with the first light output data at a second rate that is faster than the first rate; and causing the second display driver circuitry to illuminate the even-numbered rows of the light emitting elements sequentially and in accordance with the second light output data at the second rate;

wherein the loading and illuminating operations of the respective sets of rows overlap in time;

wherein each row of light emitting elements is illuminated once, not multiple times, per frame.

2. The display of claim 1, wherein the one or more controllers are further configured to wait a predefined time period since loading a first row of the light emitting elements with the first light output data before causing the first display driver circuitry to illuminate the first row of the light emitting elements.

3. The display of claim 1, wherein:

the one or more controllers are further configured to:

cause the first display driver circuitry and the second display driver circuitry to load the light emitting elements over a loading time period measured from a time of loading a first row of the light emitting elements with the first light output data to a time of loading a last row of the light emitting elements with at least one of the first light output data or the second light output data; and cause the first display driver circuitry and the second display driver circuitry to illuminate the light emitting elements over an illumination time period measured from a time of illuminating the first row of the light emitting elements to a time of illuminating the last row of the light emitting elements; and the illumination time period is less than the loading time period.

4. The display of claim 1, wherein the display is a liquid crystal display (LCD), the array of the light emitting elements represents a backlight of the LCD, and the light emitting elements are light emitting diodes (LEDs).

5. The display of claim 1, wherein the display is an organic light emitting diode (OLED) display, the individual light emitting elements in the array of the light emitting elements are light emitting diodes (LEDs) included in individual pixels of the OLED display.

6. The display of claim 1, wherein the display is embedded in a virtual reality (VR) headset or an augmented reality (AR) headset.

7. The display of claim 1, wherein the first display driver circuitry and the second display driver circuitry are configured to load and illuminate the array of light emitting elements from opposite sides of the substrate.

8. The display of claim 1, wherein:

causing the first display driver circuitry to illuminate the odd-numbered rows of the light emitting elements sequentially comprises illuminating multiple odd-numbered rows at a time in sequence; and causing the second display driver circuitry to illuminate the even-numbered rows of the light emitting elements sequentially comprises illuminating multiple even-numbered rows at a time in sequence.

9. A method implemented by a display having an array of light emitting elements arranged on a substrate that is parallel to a frontal plane of the display in rows and columns, wherein the rows of the light emitting elements include respective sets of rows comprising a first set of odd-numbered rows and a second set of even-numbered rows, the method comprising:

for a frame of a series of frames that present images on the display, performing loading and illuminating operations for the respective sets of rows by:

loading the odd-numbered rows of the light emitting elements sequentially with first light output data at a first rate;

loading the even-numbered rows of the light emitting elements sequentially with second light output data at the first rate;

illuminating the odd-numbered rows of the light emitting elements sequentially in accordance with the first light output data at a second rate that is faster than the first rate; and illuminating the even-numbered rows of the light emitting elements sequentially in accordance with the second light output data at the second rate;

wherein the loading and illuminating operations of the respective sets of rows overlap in time;

wherein each row of light emitting elements is illuminated once, not multiple times, per frame.

10. The method of claim 9, further comprising waiting a predefined time period since loading a first row of the light emitting elements with the first light output data before illuminating the first row of the light emitting elements.

11. The method of claim 9, wherein:

the loading of the odd-numbered rows and the loading of the even-numbered rows is performed over a loading time period measured from a time of loading a first row of the light emitting elements with the first light output data to a time of loading a last row of the light emitting elements with at least one of the first light output data or the second light output data;

the illuminating of the odd-numbered rows and the illuminating of the even-numbered rows is performed over an illumination time period measured from a time of illuminating the first row of the light emitting elements to a time of illuminating the last row of the light emitting elements; and the illumination time period is less than the loading time period.

12. The method of claim 9, wherein:

the illuminating of the odd-numbered rows and the illuminating of the even-numbered rows is performed over an illumination time period measured from a time of illuminating a first row of the light emitting elements to a time of illuminating a last row of the light emitting elements; and the illumination time period of the frame is no greater than about ⅓ of a frame time of the frame.

13. The method of claim 9, wherein:

the illuminating of the odd-numbered rows and the illuminating of the even-numbered rows is performed over an illumination time period measured from a time of illuminating a first row of the light emitting elements to a time of illuminating a last row of the light emitting elements;

a refresh rate of the display is at least about 75 hertz (Hz); and the illumination time period of the frame is no greater than about 3 milliseconds (ms).

14. The method of claim 9, wherein:

first display driver circuitry performs the loading and the illuminating of the odd-numbered rows of the light emitting elements from a first side of the substrate; and second display driver circuitry performs the loading and the illuminating of the even-numbered rows of the light emitting elements from a second side of the substrate opposite the first side.

15. A display comprising:

an array of light sources arranged on a substrate that is parallel to a frontal plane of the display in rows and columns, wherein the rows of the light sources include respective sets of rows comprising a first set of odd-numbered rows and a second set of even-numbered rows;

display driver circuitry coupled to the array of light sources via conductive paths, the display driver circuitry including:

first display driver circuitry coupled to the odd-numbered rows of the light sources via the conductive paths; and second display driver circuitry coupled to the even-numbered rows of the light sources via the conductive paths; and one or more controllers to:

for a frame of a series of frames that present images on the display, cause performance of loading and illuminating operations for the respective sets of rows by:

causing the first display driver circuitry to load the odd-numbered rows of the light sources sequentially with first light output data at a first rate;

causing the second display driver circuitry to load the even-numbered rows of the light sources sequentially with second light output data at the first rate;

causing the first display driver circuitry to illuminate the odd-numbered rows of the light sources sequentially and in accordance with the first light output data at a second rate that is faster than the first rate; and causing the second display driver circuitry to illuminate the even-numbered rows of the light sources sequentially and in accordance with the second light output data at the second rate, wherein the loading and illuminating operations of the respective sets of rows overlap in time;

wherein each row of light sources is illuminated once, not multiple times, per frame.

16. The display of claim 15, wherein:

the series of frames present the images on the display at a refresh rate of the display;

the first display driver circuitry and the second display driver circuitry illuminate the light sources over an illumination time period measured from a time of illuminating a first row of the light sources to a time of illuminating a last row of the light sources; and the illumination time period of the frame is within a range of about 2% to 80% of a frame time of the frame, the frame time derivable from the refresh rate.

17. The display of claim 15, wherein:

the conductive paths are arranged in horizontal lines and vertical lines on the substrate; and the display driver circuitry is configured address an individual light source of the light sources via a pair of a horizontal line and a vertical line that intersects at the individual light source for loading light output data that is particular to the individual light source.

18. The display of claim 15, wherein the first display driver circuitry and the second display driver circuitry are configured to load and illuminate the array of light sources from opposite sides of the substrate.

19. The display of claim 15, wherein:

causing the first display driver circuitry to illuminate the odd-numbered rows of the light sources sequentially comprises illuminating multiple odd-numbered rows at a time in sequence; and causing the second display driver circuitry to illuminate the even-numbered rows of the light sources sequentially comprises illuminating multiple even-numbered rows at a time in sequence.

* * * * *